US008622035B2

(12) United States Patent
Meintschel et al.

(10) Patent No.: US 8,622,035 B2
(45) Date of Patent: Jan. 7, 2014

(54) VALVE DRIVE CONTROL DEVICE

(75) Inventors: Jens Meintschel, Bernsdorf (DE); Thomas Stolk, Kirchheim (DE); Alexander von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 239 days.

(21) Appl. No.: 13/136,759

(22) Filed: Aug. 10, 2011

(65) Prior Publication Data

US 2012/0037102 A1 Feb. 16, 2012

Related U.S. Application Data

(63) Continuation-in-part of application No. PCT/EP2010/000429, filed on Jan. 26, 2010.

(30) Foreign Application Priority Data

Feb. 11, 2009 (DE) ..... 10 2009 008 422

(51) Int. Cl.
*F01L 9/04* (2006.01)

(52) U.S. Cl.
USPC ..... 123/90.11

(58) Field of Classification Search
USPC ..... 123/90.16, 90.11; 251/129.01, 129.15, 251/129.16
See application file for complete search history.

(56) References Cited

U.S. PATENT DOCUMENTS

| | | | | |
|---|---|---|---|---|
| 5,544,628 | A * | 8/1996 | Voigt | 123/90.16 |
| 6,967,550 | B2 * | 11/2005 | Elendt et al. | 335/229 |
| 7,409,938 | B2 * | 8/2008 | Dengler | 123/90.18 |

FOREIGN PATENT DOCUMENTS

| | | |
|---|---|---|
| CN | 200680025863 | 7/2008 |
| DE | 201 14 466 | 2/2002 |
| DE | 10 20063 015 233 | 10/2007 |
| DE | 10 2006 051 809 | 5/2008 |
| DE | 10 2006 059188 A1 | 6/2008 |

* cited by examiner

*Primary Examiner* — Ching Chang
(74) *Attorney, Agent, or Firm* — Kraus J. Bach

(57) ABSTRACT

In a valve drive control device, in particular for an internal combustion engine, for controlling the position of a cam element on a camshaft, the valve drive comprises at least one control armature element and a control element connected to the control armature element for engagement with a control gate of the cam element for controlling axial positioning of the cam element on the camshaft. The valve drive control device has a coupling unit which is provided to couple the control armature element and the control element movably to each other with at least one degree of freedom.

11 Claims, 6 Drawing Sheets

VALVE DRIVE CONTROL DEVICE

This is a Continuation-In-Part application of pending international patent application PCT/EP2010/000429 filed Jan. 26, 2010 and claiming the priority of German patent application 10 2009 008 422.3 filed Feb. 11, 2009.

BACKGROUND OF THE INVENTION

The invention relates to a valve drive control device for controlling a valve drive in particular of an internal combustion engine, with an armature element having a control element for coupling the armature element to a cam element for controlling axial positioning of the cam element.

DE 10 2006 051 809 A1 discloses a valve drive control device, particularly for an internal combustion engine, for controlling a valve drive with at least one control armature element provided for a control movement, and with a control element provided for a engagement in a control gate of a cam element, wherein the control armature element and the control element can be moved relative to each other in a longitudinal direction.

From DE 10 2006 015 233 A1a valve drive control device, particularly for controlling a valve drive in an internal combustion engine, is known. The valve drive control device comprises at least one control armature element which is provided for a control movement, and a control element, which is provided for a coupling to a control gate of a cam element, wherein the control armature element and the control element are coupled to each other.

In DE 10 2006 059 188 A1a valve drive control device, particularly for controlling a valve drive in an internal combustion engine, is described, which has at least one control armature element provided for a control movement, and a control element provided for a coupling to a control gate of a cam element, wherein a coupling of the control armature element and the control element is provided.

It is the principal object of the invention to optimize a control process triggered by the valve drive control device.

SUMMARY OF THE INVENTION

In a valve drive control device, in particular for an internal combustion engine, for controlling the position of a cam element on a camshaft, the valve drive comprises at least one control armature element and a control element for engagement with a control gate of the cam element for controlling axial positioning of the cam element on the camshaft. The valve drive control device has a coupling unit which is provided to couple the control armature element and the control element movably to each other with at least one degree of freedom.

It is suggested that the valve drive control device has a coupling unit which is provided for coupling the control armature element and the control element movably to each other with at least one degree of freedom. An advantageous guidance of the control element can be achieved thereby, whereby a control process implemented by means of the valve control device can be optimized in a particularly simple manner. A "degree of freedom" is particularly meant to be a movement parameter of a system, which is independent of further parameters, as for example a linear movement and/or a rotational movement. The coupling unit preferably has at least two degrees of freedom and particularly preferred at least three degrees of freedom.

The control element is preferably formed at least partially as a slide shoe. The control element can thereby be coupled to the control gate in a particular advantageous manner.

It is further suggested that the control armature element is formed at least partially as, or provided with, a control pin. The control element can thereby be coupled to the control movement of the control armature in a particularly simple manner.

It is further suggested that the coupling unit is provided for at least one degree of freedom in the form of a rotational movement. A particularly simple and advantageous coupling between the control element and the control armature element can be achieved thereby.

It is further suggested that the at least one degree of freedom is formed as a rotational movement around a rotational axis extending along the direction of a main extension of the control armature element. The control element can thereby advantageously adapt to the course of a gate path and the course of a displacement curve of the gate path in its orientation in a particularly simple manner. The rotational movement is preferably formed as a free rotational movement, where a possible angle of the rotational movement is 360° and a free rotational movement is thus possible. The rotational movement can basically also be restricted.

It is further suggested that the at least one degree of freedom is formed as a rotational movement around a rotational axis along a main direction of extension of the control element. A lateral tilting of the control element can thereby be compensated in an effective manner. This rotational movement is advantageously formed as a restricted rotational movement, that is, a rotational movement, whose possible angle is restricted to an angle smaller than 360°.

It is further suggested that the at least one degree of freedom is formed as a rotational movement around a rotational axis vertical to a main extension direction of the control armature element and/or vertical to a main direction of extension of the control element. A height course of the gate path can thereby be compensated in a particular advantageous manner. This rotational movement is preferably also formed as a restricted rotational movement.

It is further suggested that the coupling unit comprises a ball head and a recess corresponding to the ball head. The coupling unit can thereby be constructively designed in a particularly simple manner. A coupling unit can thereby particularly be provided, which only has degrees of freedom in the form of rotational movements.

It is further suggested that the ball head is arranged at one end of the control armature element. A particularly simple forming of the coupling unit can be achieved thereby.

It is further suggested that the recess is formed at least partially within the control element. A guide of the control element can thereby be provided in a particularly simple manner. Furthermore, an additional constructions space can be saved by the design of the recess formed for receiving the ball head within the control element. "Within the control element" is thereby particularly meant to be spatially between functional surfaces of the control element.

The coupling unit is preferably provided for a form-fit coupling. A coupling between the control armature element and the control element can thereby be provided, which can be assembled in a particularly simple manner and which has a high load capacity.

It is further suggested that the control element is formed in a rotation-symmetrical manner. An advantageous guide of the control element by means of the control gate can be achieved thereby. "Rotation symmetrical" shall thereby particularly mean at least partially ellipsoidal.

It is further suggested that the control element has a slot, which is provided as a spring means for a form-fit connection between the control armature element and the control element. Thereby, a particularly simple spring element for establishing an assembly-friendly form-fit connection can be provided, as the coupling unit for a snap connection can be provided thereby. Other spring means for producing a snap connection between the control element and the control armature element are basically also conceivable. A sleeve inserted into the control element can for example also be provided for providing a spring means.

It is additionally suggested that the control element has a side surface, which is formed at least partially as at least one functional surface and which is provided to correspond to at least one flank of a gate path of the control gate. A moving contact point between the functional surface and the flank of the gate path can be realized thereby, whereby a tolerance with regard to angle errors of components of the valve drive control device can be increased. Particularly, a wear of the control element and the gate path can thereby be reduced effectively and constructively. A "functional surface" is particularly meant to be a region at the side surface of the control element for the functional coupling to the control gate. As "corresponding" is particularly meant that a curvature of the functional surface is adapted to a curvature of the flank of the gate path.

The invention will become more readily apparent from the following description of an embodiment of the invention on the basis of the accompanying drawings.

DESCRIPTION OF A PARTICULAR EMBODIMENT OF THE INVENTION

Figure 1:
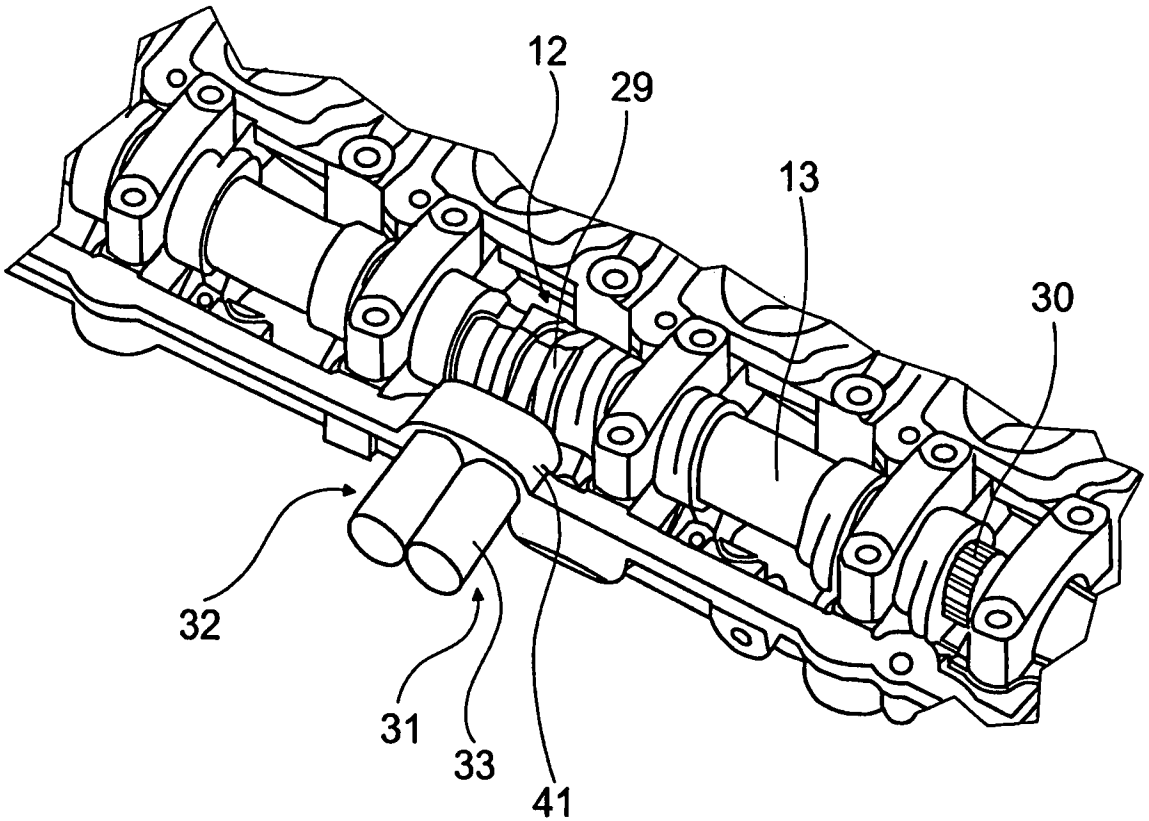
FIG. 1 is a top view of a valve drive control device with axially displaceable cam elements.

FIG. 1 shows a valve drive control device for an internal combustion engine. The valve drive control element has at least one cam element 13, which is disposed on a base shaft 30 in an axially slidable but rotationally fixed manner. The valve drive control device further has an actuation device 31, by means of which a control force for displacing the at least one cam element 13 is provided.

The actuation device 31 has a control unit 32 with at least one actuating actuator 33 and with a control gate 12 with at least one gate path 29. The actuating actuator 33 comprises a control armature element 10 and a control element 11. In a control position, in which the control armature element 10 is extended, the control element 11 engages the control gate 12, so that, by a rotational movement of the cam element 13, an axially acting control force is provided. In a neutral position, the control element 11 is retracted from the control gate 12. A second actuating actuator, not designated in detail, for engagement with a second gate path is designed in an analogous manner.

The actuating actuator 33 has an electromagnetic unit 34 with a stator unit 35 and an armature unit 36. The stator unit 35 comprises a solenoid 37 and a solenoid core 38, by means of which a solenoid magnetic field that can be generated by the solenoid 37 can be strengthened. The armature unit 36 comprises a permanent magnet 39, which is rigidly connected to the control armature element 10. By means of the solenoid 37 and the permanent magnet 39, an actuation force for controlling the control armature element 10 is provided, which acts along a main extension direction 15 of the control armature element 10. The control armature element 10 is mounted in a movable manner along its main extension direction 15.

Figure 2:
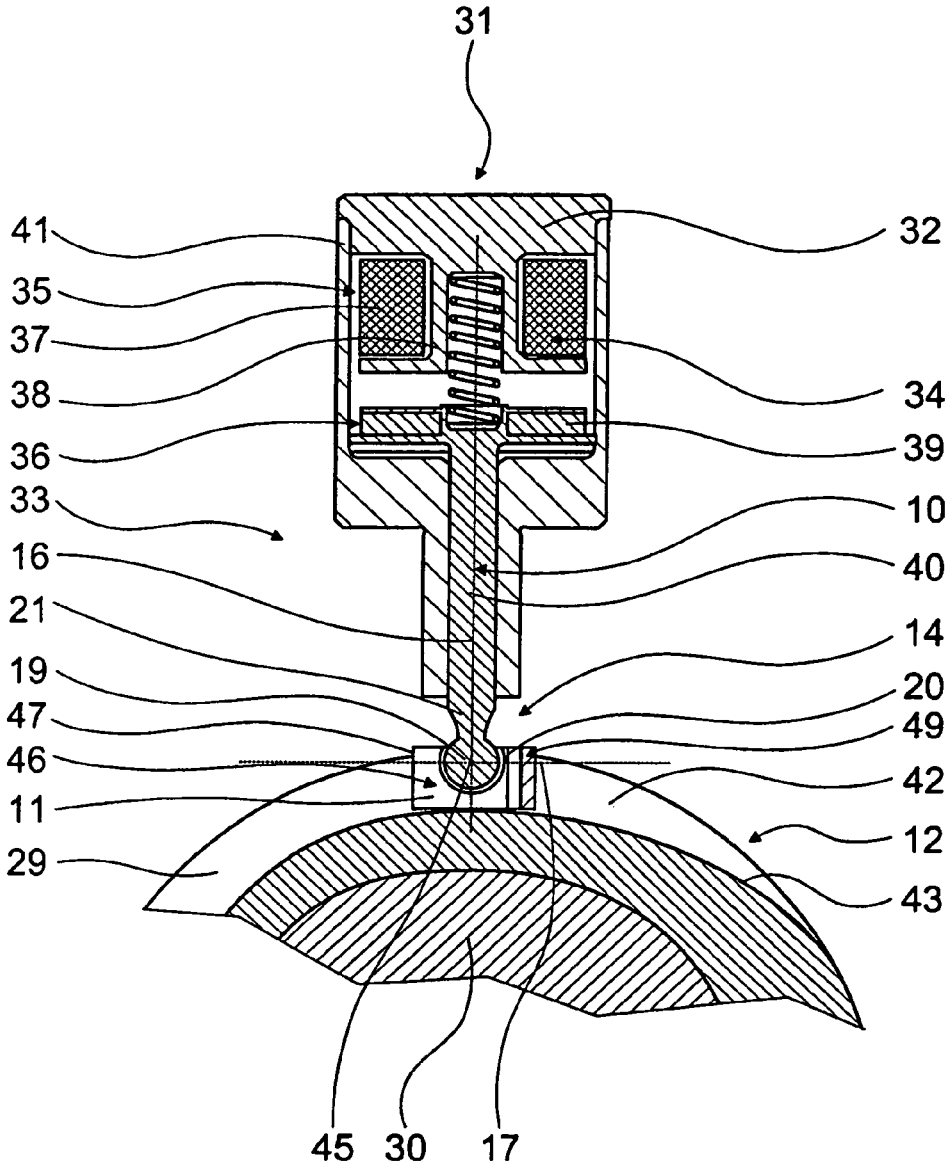
FIG. 2 shows an actuating actuator of the valve drive control device.

The control armature element 10 of the actuating actuator 33 is partially formed as a control pin 40. The control element 11 of the actuating actuator 33 in the form of a slide shoe (see FIG. 2). The control element 11 is formed in one piece and engages the gate path 29 in the control position. The control pin 40 is mounted in an actuator housing 41 of the actuating actuator 33 and extends through the actuator housing 41.

If the solenoid 37 is de-energized, the permanent magnet 39 interacts with the surrounding material. In the neutral position, the permanent magnet 39 particularly interacts with the solenoid core 38 of the electromagnetic unit 34, which consists of a magnetizable material. In the control position, the permanent magnet 39 particularly interacts with the actuator housing 41 of the actuating actuator 33. In an operating state without current, the permanent magnet 64*a* retains the control element 11 in the control position or the neutral position. The actuating actuator 33 is designed as a bistable system, which is held either in the control position or the neutral position in a de-energized state of the solenoid.

In an operating state, in which the electromagnetic unit 34 is energized, the permanent magnetic field of the permanent magnet 39 interacts with the magnetic field of the solenoid 37. An attracting force and a repelling force can thereby be realized in dependence on a polarization of the permanent magnet 39 and the electromagnetic unit 34. A polarization of the electromagnetic unit 34 can be adjusted by means of the direction of the current, with which the solenoid 37 is supplied. In order to move the switch element 10 from its neutral retracted position to the extended switch position, the electromagnetic unit 37 is energized with a current in the current direction, which results in a repellent force between the electromagnetic unit 34 and the permanent magnet 39.

For providing the axially acting control force, the gate path 29 has an axial and a radial directional component. If the actuating actuator 33 is in the control position, a rotational movement of the cam element 13 the axially acting force is generated by the axial direction component of the gate path 29, by means of which force the cam element 13 is displaced. In order to move the actuating actuator 33 into its neutral position after a displacement of the cam element, the gate path has a disengagement element 42, which is formed by a groove base 43 of the gate path 29 rising up to a base circle level. By means of the disengagement element 42, a force acts on the actuating actuator 33, which returns the control armature element 10 back into its neutral position.

Upon movement of the control armature element 10 from its control position into the retracted neutral position by the disengagement element 42, the control armature element 10 is held in a first phase in the control position as a result of an interaction between the permanent magnet 39 and the actuator housing 41. In a second phase, the control armature element 10 releases from the groove base 43 and aims for the neutral position by the interaction between the permanent magnet 39 and the solenoid core 38. The control armature element 10 is moved to its neutral position by the interaction between the permanent magnet 39 and the solenoid core 38 in the second phase independently of the rotational movement of the cam element 13.

Figure 3:
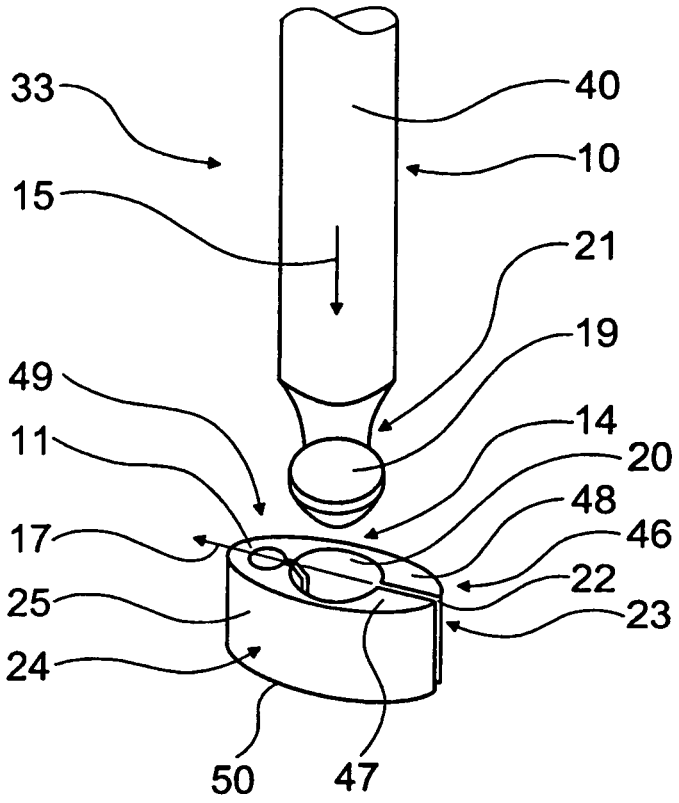
FIG. 3 shows a control armature element and a control element of the actuating actuator in a disassembled state, FIG. 4 the control armature element and the control element in an assembled state.

The control armature element 10 and the control element 11 are coupled to each other in a movable manner by means of a coupling unit 14. The coupling unit 14 comprises a ball head 19 arranged at one end 21 of the control armature element 10 and a recess 20 corresponding to the ball head 19, which recess is arranged in the control element 11 (see FIG. 3). The control armature element 10 and the ball head 19 are designed in one piece. In an assembled state, the control armature element 10 and the control element 11 are connected to each other in a form-fit manner by means of the ball head 19 and the corresponding recess 20. The recess 20 of the control element 11 receives the ball head 19 therein. The control armature element 10 and the control element 11 are coupled to each other in three degrees of freedom in a movable manner by means of the coupling unit 14.

Figure 6:
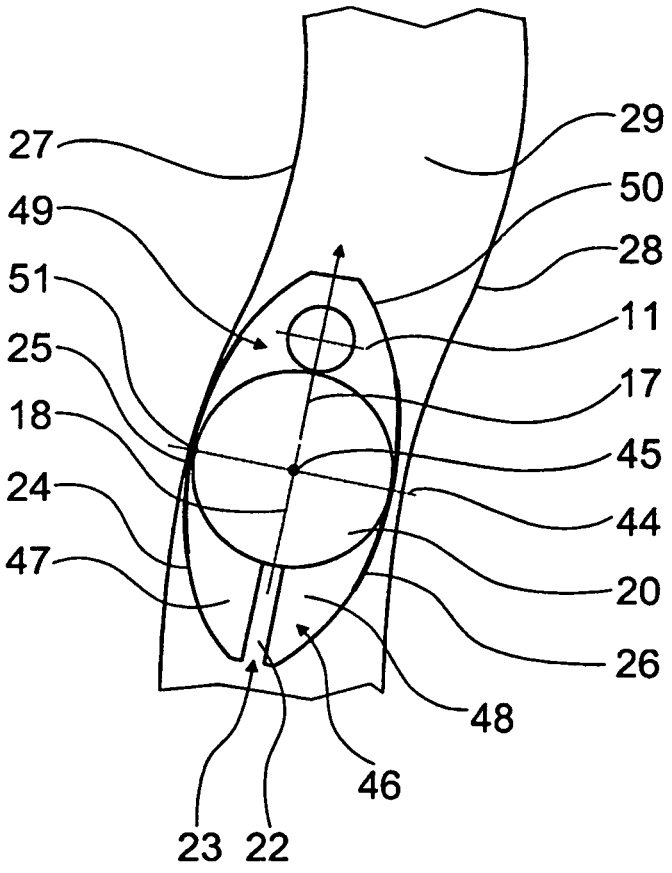

The three degrees of freedom are rotational movements between the control armature element 10 and the control element 11 independent of each other. Rotational axes 16, 18, 44 for all three degrees of freedom are defined by means of the ball head 19 and the recess 20 The three rotational axes 16, 18, 44 have a common intersection 45. The three rotational axes 16, 18, 44 are aligned vertically to each other (see FIG. 6).

Figure 4:
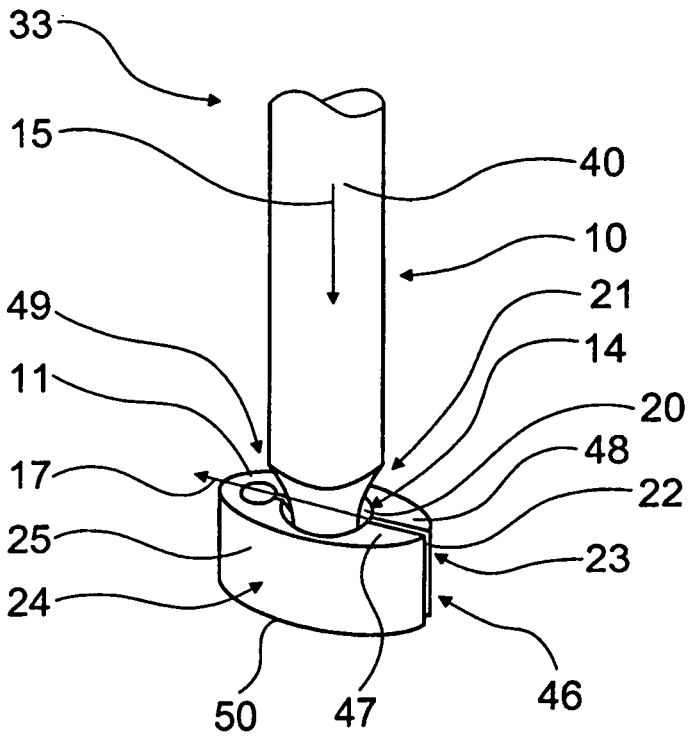

The rotational axis 16 for the rotational movement of the first degree of freedom extends along the longitudinal axis 15 of the control armature element 10. The control element 11 can rotate freely around the longitudinal axis direction 15 of the control armature element 10 which also forms the rotational axis 16 by an angle of 360°. The rotational movement of the first degree of freedom can basically be restricted to a defined angle region by means of a guide element, for example an angle region adapted to the gate path. The rotational axis 18 for the rotational movement of the second degree of freedom extends along a main extension direction 17 of the control element 11 (see FIG. 4). The rotational movement around the rotational axis 18 is restricted. The rotational axis 44 for the rotational movement of the third degree of freedom extends vertically to the main extension direction 17 of the control element and vertically to the main extension direction 15 of the control armature element 10. The rotational movement around the rotational axis 44 is also restricted.

For an assembly of the actuating actuator 33, the coupling unit 14 has a spring means 23, by means of which the recess 20 corresponding to the ball head 19 can be widened, in order to introduce the ball head 19 into the recess 20. The spring means 23 is formed in one piece with the control element 11. In order to form the spring element 23, the control element 11 has a slot 22 applied along the main extension direction 17 of the control element 11. The slot 22 is introduced centrally into the control element 11. It passes through the control element 11 to an essential part. In a rear region 46, two halves 47, 48 of the control element 11 are separated from each other by the slot 22. In a front region 49, the two halves 47, 48 are connected to each other by the one-piece formation of the control element 11.

With an assembly of the coupling unit 14, the slot 22 widens for a short period, while the ball head 19 is pressed into the recess 20. By means of the force of the retracting ball head 19, the slot 22 and therewith the halves 47, 48 of the control element 11 formed as a slide shoe are pressed apart and the ball head 19 engages the recess 20. As soon as the ball head 19 is in the recess 20, the halves 47, 48 of the control element 11 snap back into their starting position. A sliding out of the ball head 19 from the recess 20 is prevented by the spring means 23, which is formed by means of the slot 22.

Figure 5:
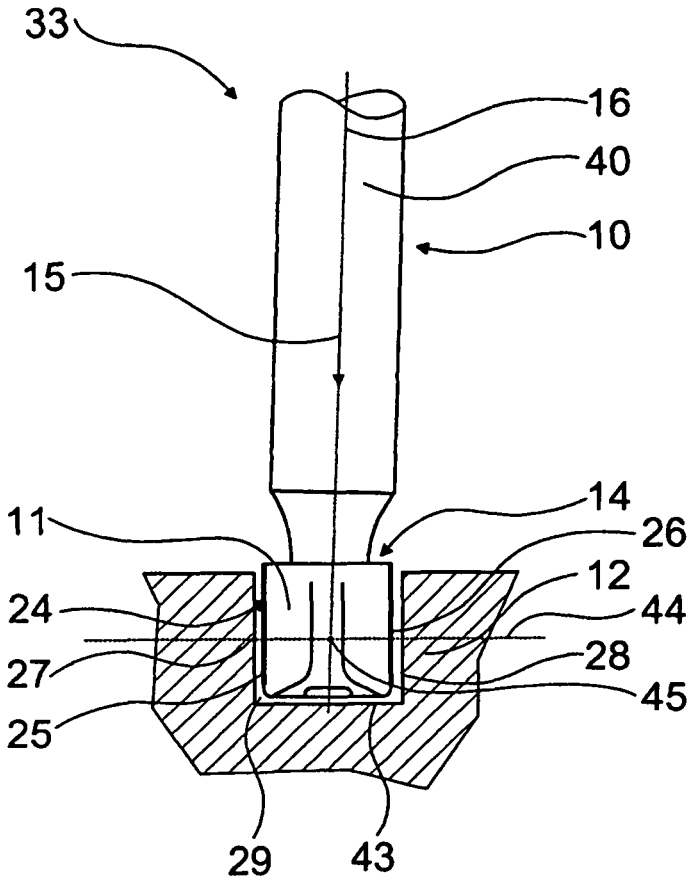
FIG. 5 shows the control armature element and the control element and FIG. 6 shows the control element in a controlled state.

The control element 11, formed as a slide shoe, has a rotation-symmetrical basic form 50 (see FIG. 5). The rotation-symmetrical basic form 50 of the control element 11 formed as a slide shoe has two functional surfaces 25, 26, which are formed as parts of a side surface 24 of the control element 11. The functional surfaces 25, 26 are provided for engagement with the gate path 29. The functional surfaces 25, 26 are formed as contact surfaces between the control element 11 and flanks 27, 28 of the gate path 29. The functional surfaces 25, 26 correspond to the flanks 27, 28 of the gate path 29. A curvature of the functional surfaces 25, 26 is larger than a maximum curvature of the gate path 29. When displacing the cam element 13 during a control process, a coherent part at least of the corresponding functional surface 25, 26 is always in contact with the associated flank 27, 28 of the gate path 29.

By means of the rotation-symmetric basic form 50 and the free rotatability of the control element 11 formed as a slide shoe, a contact point 51 wanders in contact with the corresponding flank 27 of the gate path, which is defined by the contact between the functional surfaces 25, 26 with the associated flank 27, 28. Depending on an angle degree of the gate path 29, a relative position of the contact point 51 wanders with regard to the control element 11 or to the functional surfaces 25, 26 of the control element 11.

What is claimed is:

1. A valve drive control device for a camshaft of an internal combustion engine, for controlling operation of a valve drive, the device comprising at least one control armature element (10), and a slide control element (11) connected to the control armature element (10) provided for a coupling to a control gate (12) of a cam element (13) for controlling the axial position of the cam element (13) on the camshaft, and a coupling unit (14) arranged at one end (21) of the control armature element (10) for coupling the control armature element (10) and the slide control element (11) movably to each other with at least one degree of freedom the slide control element (11) the form of an elongated slide shoe pivotally joined to the control armature element (10) by the coupling unit (14).

2. The valve drive control device according to claim 1 wherein the control armature element (10) is formed at least partially as a control pin (40).

3. The valve drive control device according to claim 1, wherein the coupling unit (14) is provided for at least one degree of freedom formed as rotational movement.

4. The valve drive control device according to claim 3, wherein the at least one degree of freedom is formed as a rotational movement around a rotational axis (16) extending along to a main extension direction (15) of the control armature element (11).

5. The valve drive control device according to claim 3, wherein the at least one degree of freedom is formed as a rotational movement around a rotational axis (44) extending vertically to a main extension direction (15) of the control armature element (10) and vertically to a main extension direction (17) of the slide control element (11).

6. The valve drive control device according to claim 1, wherein the coupling unit (14) comprises a ball head (19) and a recess (20) formed in the slide shoe (11) and accommodating the ball head (19).

7. The valve drive control device according to claim 6, wherein the recess (20) is formed at least partially within the slide control element (11).

8. The valve drive control device according to claim 1, wherein the coupling unit (14) is a form-fit coupling.

9. The valve drive control device according to claim 1, wherein the slide control element (11) is formed in a rotation-symmetrical manner.

10. The valve drive control device according to claim 9, wherein the slide control element (11) has a slot (22), which is provided to form a spring means (23) for a form-fit connection between the control armature element (10) and the slide control element (11).

11. The valve drive control device according to claim 1, wherein the slide control element (11) has a side surface (24), which is formed at least partially as a functional surface (25, 26) and which is provided to correspond with at least one flank (27, 28) of a gate path (29) of the control gate (12).

* * * * *